US008125396B2

(12) United States Patent
Huang et al.

(10) Patent No.: US 8,125,396 B2
(45) Date of Patent: Feb. 28, 2012

(54) HANDHELD ELECTRONIC DEVICE

(75) Inventors: Huan-Chu Huang, Taoyuan County (TW); Jen-Chen Lu, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 247 days.

(21) Appl. No.: 12/481,590

(22) Filed: Jun. 10, 2009

(65) Prior Publication Data

US 2010/0149046 A1 Jun. 17, 2010

(30) Foreign Application Priority Data

Dec. 17, 2008 (TW) ..... 97149287 A

(51) Int. Cl.
*H01Q 1/24* (2006.01)

(52) U.S. Cl. ..... 343/702; 343/846; 343/872

(58) Field of Classification Search ..... 343/702, 343/846

See application file for complete search history.

(56) References Cited

U.S. PATENT DOCUMENTS

| | | | | |
|---|---|---|---|---|
| 6,388,626 | B1 * | 5/2002 | Gamalielsson et al. | 343/702 |
| 6,563,042 | B2 * | 5/2003 | Barabash | 174/359 |
| 7,009,563 | B2 * | 3/2006 | Mori et al. | 343/700 MS |
| 7,825,862 | B2 * | 11/2010 | Cheng et al. | 343/702 |
| 2002/0172023 | A1 * | 11/2002 | Blakely et al. | 361/763 |
| 2008/0165067 | A1 * | 7/2008 | Kim | 343/702 |
| 2009/0115669 | A1 * | 5/2009 | Cheng | 343/702 |

* cited by examiner

*Primary Examiner* — Douglas W Owens
*Assistant Examiner* — Jennifer F Hu
(74) *Attorney, Agent, or Firm* — Jianq Chyun IP Office

(57) ABSTRACT

A handheld electronic device comprising an appearance provided with a containing space for disposing a communication module and a substrate having a ground plane; an antenna disposed on a surface of the appearance; and, a first fastening element and a second fastening element for fixing the appearance and the substrate. The first fastening element and the second fastening element electrically connect the antenna to the ground plane and the communication module.

16 Claims, 3 Drawing Sheets

HANDHELD ELECTRONIC DEVICE

CROSS-REFERENCE TO RELATED APPLICATION

This application claims the priority benefit of Taiwan application serial No. 97149287, filed on Dec. 17, 2008. The entirety of the above-mentioned patent application is hereby incorporated by reference herein and made a part of this specification.

BACKGROUND OF THE INVENTION

1. Field of the Invention

The application generally relates to an electronic device. More particularly, the application relates to an antenna design of a handheld electronic device.

2. Description of Related Art

Currently, wireless communication has become a more popular choice for human beings to communicate with each other. Correspondingly, there have been developed many kinds of wireless communication apparatuses, such as smart cell phones, multimedia players, personal digital assistants (PDAs), and global positioning systems (GPSs). Almost all of the electronic apparatus capable of wireless transmittance are developed with a concept toward light weight and slimness, so as to become more welcome to the consumers.

Generally, antennas are critical components for handheld electronic devices to receive or transmit signals. To give an artistic appearance of a handheld electronic device, a conventional antenna is usually hided within a handheld electronic device. However, the conventional antenna occupies a part of the inner space, and the restricted space may lead to significant difficulty in antenna design or obvious degradation of antenna performance.

SUMMARY OF THE INVENTION

Accordingly, the application is directed to a handheld electronic device capable of providing good antenna performance and sufficient containing space.

As embodied and broadly described herein, the application provides a handheld electronic device comprising an appearance provided with a containing space for disposing a communication module and a substrate having a ground plane; an antenna disposed on a surface of the appearance; and, a first fastening element and a second fastening element for fixing the appearance and the substrate. The first fastening element and the second fastening element electrically connect the antenna to the ground plane and the communication module.

According to an embodiment of the present invention, the antenna comprises a ground region electrically connected to the ground plane and a feed-in region electrically connected to the communication module.

According to an embodiment of the present invention, the handheld electronic device further comprises a first fastening hole penetrating the appearance and the antenna, and a second fastening hole penetrating the substrate. The first fastening element is fastened in the first fastening hole and the second fastening hole such that the antenna and the ground region are electrically connected to the ground plane via the first fastening element.

According to an embodiment of the present invention, the handheld electronic device further comprises an first opening penetrating the appearance, by which the antenna extends into the containing space; a third fastening hole penetrating the antenna in the first opening; and, a fourth fastening hole covered by a second electroplating layer and penetrating the substrate. The first fastening element is fastened in the third fastening hole and the fourth fastening hole such that the antenna extending into the containing space is in contact with the second electroplating layer and electrically connected to the ground plane.

According to an embodiment of the present invention, the handheld electronic device further comprises a fifth fastening hole penetrating the appearance and the antenna and a sixth fastening hole penetrating the substrate. The second fastening element is fastened into the fifth fastening hole and the sixth fastening hole such that the antenna and the feed-in region are electrically connected to the communication module via the second fastening element.

According to an embodiment of the present invention, the handheld electronic device further comprises a second opening penetrating the appearance such that the antenna extends into the containing space; a seventh fastening hole penetrating the antenna in the second opening; and, an eighth fastening hole covered by a fourth electroplating layer and penetrating the substrate. The second fastening element is fastened into the seventh fastening hole and the eighth fastening hole such that the antenna extending into the containing space is in contact with the fourth electroplating layer and electrically connected to the communication module.

Accordingly, the antenna of the handheld electronic device of the application covers a surface of the appearance and occupies no inner space of the handheld electronic device, and the performance of the antenna can also be improved. Elements in the handheld electronic device can be capable of fixing and electrically connecting to each other by adopting various fasteners in different material. Therefore, the requirement of components can be reduced so as to save the manufacturing cost and enhance the rigidity of the whole structure.

BRIEF DESCRIPTION OF THE DRAWINGS

The accompanying drawings are included to provide a further understanding of the application, and are incorporated in and constitute a part of this specification. The drawings illustrate embodiments of the invention and, together with the description, serve to explain the principles of the invention.

DESCRIPTION OF THE EMBODIMENTS

Figure 1:
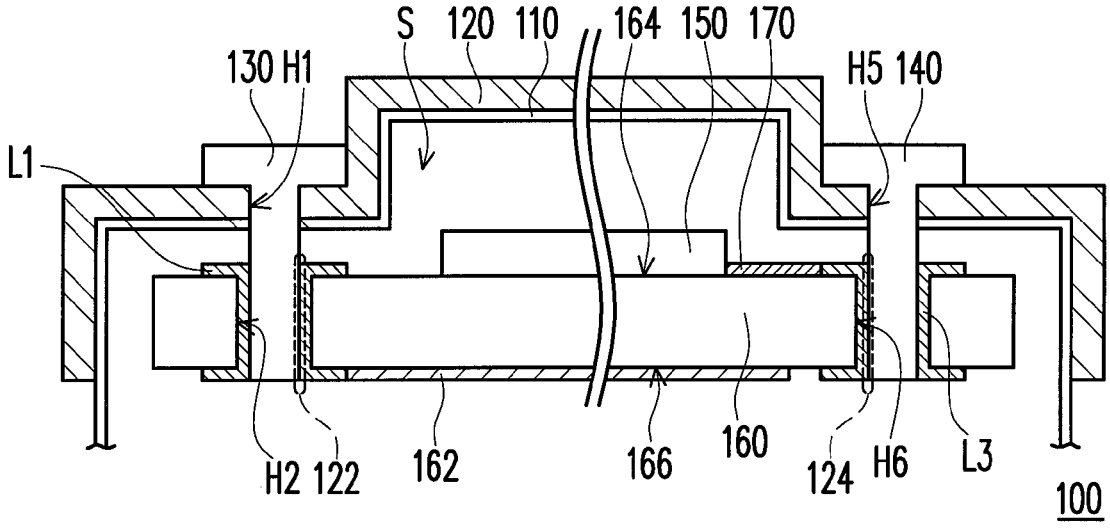
FIG. 1 is a partial cross-sectional view of a handheld electronic device according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a partial cross-sectional view of a handheld electronic device according to an embodiment of the present invention. Referring to FIG. 1, the handheld electronic device 100 of this embodiment may be a smart phone, a multimedia player, a PDA, or a GPS, etc. The handheld electronic device 100 includes an appearance 110, and antenna 120, a first fastening element 130 and a second fastening element 140. The appearance 110 has a containing space S for disposing a communication module 150 and a substrate 160 having a ground plane 162. The antenna 120 is disposed on a surface of the appearance 110. The first fastening element 130 and the second fastening element 140 are used for fixing the appearance 110 and the substrate 160 so as to electrically connect the antenna 120 to the ground plane 162 and the communication module 150.

It is noted that the antenna 120 is disposed on a surface of the appearance 110 instead of occupying the containing space S of the handheld electronic device 100, such that the handheld electronic device 100 has sufficient inner space for disposing other elements. In addition, comparing to the conventional antenna disposed within the handheld electronic device, the antenna 120 of the present invention is disposed on a surface of the appearance 110 with larger radiation area, longer resonance path, higher relative height, and thus provides better performance. The so-called appearance 110 has a plurality of surfaces and may be embodied in a part of a phone housing (such as the housing itself, a back cover, or a battery cover), a part of a surface of a battery, or a part of another additional element attached on the phone housing, while the antenna 120 refers to a radiator thereof.

More particularly, comparing to the conventional antenna disposed within the handheld electronic device, the antenna 120 covering the surface of the appearance 110 is far away from the head of a user so as to alleviate the phantom effect or interference to a hearing aid compatibility (HAC) or other equipments on the head. Furthermore, the antenna 120 is far away from the inner circuits of the handheld electronic device 100 for preventing the interference with each other.

In this embodiment, the substrate 160 may be a printed circuit board and has a first surface 164 and a second surface 166 opposite to the first surface 164. The communication module 150 and the ground plane 162 are respectively disposed on the first surface 164 and the second surface 166. The antenna 120 comprises a ground region 122 and a feed-in region 124. Methods for electrically connecting the antenna to the ground plane are illustrated in the following.

Referring to FIG. 1, in this embodiment, the antenna 120 is electrically connected to the ground plane 162 via the ground region 122, and electrically connected to the communication module 150 via the feed-in region 124. The handheld electronic device 100 further comprises a first fastening hole H1 and a second fastening hole H2. The first fastening hole H1 penetrates the appearance 110 and the antenna 120. The second fastening hole H2 penetrates the substrate 160. In addition, the first fastening element 130 is fastened into the first fastening hole H1 and the second fastening hole H2 such that the antenna 120 and the ground region 122 are electrically connected to the ground plane 162 through the first fastening element 130.

Furthermore, the handheld electronic device 100 further comprises a first electroplating layer L1 covers the second fastening hole H2, wherein the ground region 122 is electrically connected to the ground plane 162 via the first fastening element 130 and the first electroplating layer L1. Particularly, in this embodiment, the first fastening element 130 is made of a conductive material for fixing elements and electrically connecting the same for reducing the requirement of components so as to save the manufacturing cost and enhance the rigidity of the whole structure. It is noted that the aforementioned ground region 122 is located at a joint location of the first fastening element 130 and the first electroplating layer L1 to make grounding by the conductibility of the first fastening element 130.

Figure 2:
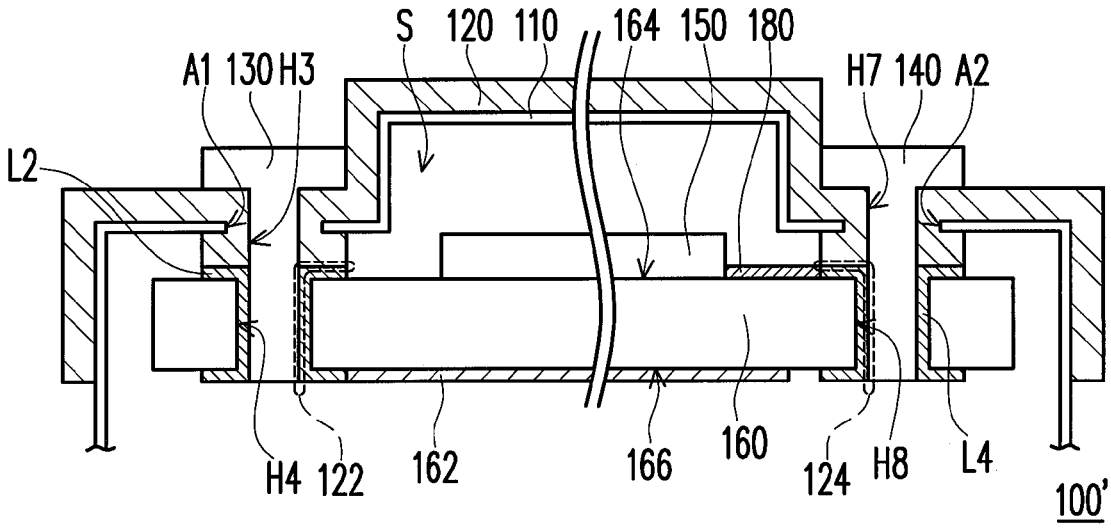
FIG. 2 is a partial cross-sectional view of a handheld electronic device according to another embodiment of the present invention.

FIG. 2 is a partial cross-sectional view of a handheld electronic device according to another embodiment of the present invention. Another manner of electrically connecting the ground plane to the antenna is illustrated herein. Referring to FIG. 2, in this embodiment, the handheld electronic device 100' further comprises a first opening A1, a third fastening hole H3 and a fourth fastening hole H4. The first opening A1 penetrates the appearance 110 such that a part radiator of the antenna 120 extends into the containing space S. The third fastening hole H3 penetrates the part of radiator of the antenna 120 disposed in the first opening A1. The fourth fastening hole H4 is covered by a second electroplating layer L2 and penetrates the substrate 160. The first fastening element 130 is fastened into the third fastening hole H3 and the fourth fastening hole H4 such that the part radiator of the antenna 120 extending into the containing space S is stacked or in contact with the second electroplating layer L2 and thereby electrically connected to the ground plane 162.

In addition, the second electroplating layer L2 is connected to the ground plane 162, wherein a part radiator of the antenna 120 is electrically connected to the ground plane 162 via second electroplating layer L2. In this embodiment, the first fastening element 130 can be provided without the function of electrically connection and can be made of conductive or insulating material. In the case of the first fastening element 130 being made of insulating material, the ground region 122 is located at a joint location of the part radiator of the antenna 120 and the second electroplating layer L2 to make grounding by the connection of the second electroplating layer L2 and the ground plane 162. In the case of the first fastening element 130 being made of conductive material, the ground region 122 is located at the joint location of the part radiator of the antenna 120 and the second electroplating layer L2 or at a joint location of the first fastening element 130 and the second electroplating layer L2 to make grounding by the conductivity of the first fastening element 130. In other words, two grounding path are provided in this embodiment, but however, the shorter one is more preferable.

Furthermore, in the above-mentioned embodiment, the first fastening element 130 further presses the part radiator of the antenna 120 extending into the containing space S to being in contact with the second electroplating layer L2 to make an electrically connection. As shown in FIG. 2, if the first fastening element 130 is loosed or incapable of providing sufficient pressing force in assembly, regular use or unexpected situation, even though the part radiator of the antenna 120 can not be maintained in contact with the second electroplating layer L2 and the grounding path formed by the radiator of the antenna 120 and the second electroplating layer L2 is failed, the first fastening element 130 is still in contact with the second electroplating layer L2 and the grounding path formed is still available for grounding connection. Therefore, this embodiment provides dual protections to grounding function.

The method of electrically connecting the antenna to the communication module is illustrated in the following. Referring to FIG. 1, the handheld electronic device 100 further comprises a fifth fastening hole H5 and a sixth fastening hole H6. The fifth fastening hole H5 penetrates the appearance 110 and the antenna 120. The sixth fastening hole H6 penetrates the substrate 160. The second fastening element 140 is fastened into the fifth fastening hole H5 and the sixth fastening hole H6 such that the antenna 120 electrically connects to the feed-in region 124 and can transmit signals to the communication module 150 through the second fastening element 140 to perform required signal processing steps.

Moreover, the handheld electronic device 100 further comprises a third electroplating layer L3 and a first circuit 170. The third electroplating layer L3 covers the sixth fastening hole H6. The first circuit 170 is connected between the third electroplating layer L3 and the communication module 150, wherein the antenna 120 is electrically connected to the communication module 150 via the second fastening element 140, the feed-in region 124, the third electroplating layer L3 and the first circuit 170. Particularly, in this embodiment, the second fastening element 140 is made of a conductive material for fixing elements and electrically connecting the same for reducing the requirement of components so as to save the manufacturing cost and enhance the rigidity of the whole structure. It is noted that the aforementioned feed-in region 124 is located at a joint location of the second fastening element 140 and the third electroplating layer L3 to feed signals and electrical connection by the conductibility of the second fastening element 140.

Another method of electrically connecting the antenna of the present invention to the communication module is illustrated in the following. Referring to FIG. 2, the handheld electronic device 100' further comprises a second opening A2, a seventh fastening hole H7 and an eighth fastening hole H8. The second opening A2 penetrates the appearance 110 such that a part radiator of the antenna 120 extends into the containing space S. The seventh fastening hole H7 penetrates the part radiator of the antenna 120 disposed in the second opening A2. The eighth fastening hole H8 is covered by a fourth electroplating layer L4 and penetrates the substrate 160. The second fastening element 140 is fastened into the seventh fastening hole H7 and the eighth fastening hole H8 such that the part radiator of the antenna 120 extends into the containing space S is stacked or in contact with the fourth electroplating layer L4 and electrically connected to the communication module 150.

The handheld electronic device 100' further comprises a second circuit 180 connected between the fourth electroplating layer L4 and the communication module 150. The part radiator of the antenna 120 is electrically connected to the communication module 150 via the fourth electroplating layer L4 and the second circuit 180. In this embodiment, the second fastening element 140 can be provided without the function of electrically connection and can be made of conductive or insulating material. In the case of the second fastening element 140 being made of insulating material, the feed-in region 122 is located at a joint location of the part radiator of the antenna 120 and the fourth electroplating layer L4, and the feed-in signals received by the antenna 120 are transmitted to the communication module 150 via the fourth electroplating layer L4 and the second circuit 180. In the case of the second fastening element 140 being made of conductive material, the feed-in region 124 is located at the joint location of the second fastening element 140 and the fourth electroplating layer L4 to make electrically connection and signal transmission by the conductivity of the second fastening element 140. In other words, two grounding path are provided in this embodiment, but however, the shorter one is more preferable.

Furthermore, in the above-mentioned embodiment, the second fastening element 140 further presses the part radiator of the antenna 120 extending into the containing space S to being in contact with the fourth electroplating layer L4 to make an electrical connection. As shown in FIG. 2, if the second fastening element 140 is loosed or incapable of providing sufficient pressing force in assembly, regular use or unexpected situation, even though the part radiator of the antenna 120 can not be maintained in contact with the fourth electroplating layer L4 and the feed-in path formed by the radiator of the antenna 120 and the fourth electroplating layer L4 is failed, the second fastening element 140 is still in contact with the fourth electroplating layer L4 and the feed-in path formed is still available for feeding signals. Therefore, this embodiment provides dual protections to signal feeding.

Figure 3:
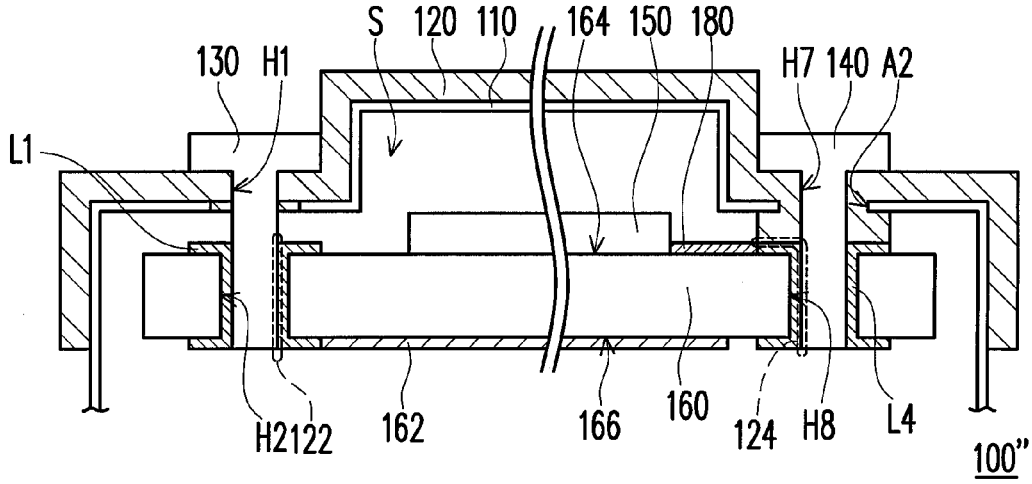
FIG. 3 is a partial cross-sectional view of a handheld electronic device according to another embodiment of the present invention.
Figure 4:
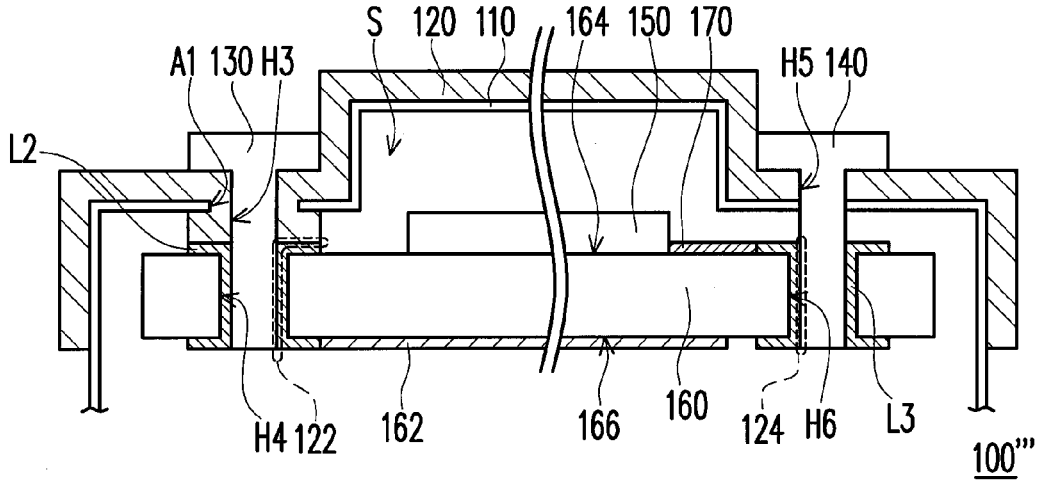
FIG. 4 is a partial cross-sectional view of a handheld electronic device according to further another embodiment of the present invention.

FIG. 3 is a partial cross-sectional view of a handheld electronic device according to another embodiment of the present invention. FIG. 4 is a partial cross-sectional view of a handheld electronic device according to further another embodiment of the present invention. The two methods of electrically connecting the antenna to the ground plane or the two methods of electrically connecting the antenna to the communication module as shown in FIGS. 1 and 2 can be combined selectively according to requirements of structural design and variations of electrical circuit to provide embodiments as the handheld electronic device 100" of FIG. 3 or the handheld electronic device 100'" of FIG. 4. The detailed contents of technology and features are referred to the aforementioned embodiments and the repeated descriptions are omitted herein. In other words, the manner of electrically connecting the antenna to the ground plane of FIG. 1 can be applied to the handheld electronic device of FIG. 3 by incorporating the manner of electrically connecting the antenna to the communication module of FIG. 2 therein. In addition, the manner of electrically connecting the antenna to the ground plane of FIG. 2 can be applied to the handheld electronic device of FIG. 4 by incorporating the manner of electrically connecting the antenna to the communication module of FIG. 1 therein.

Figure 5:
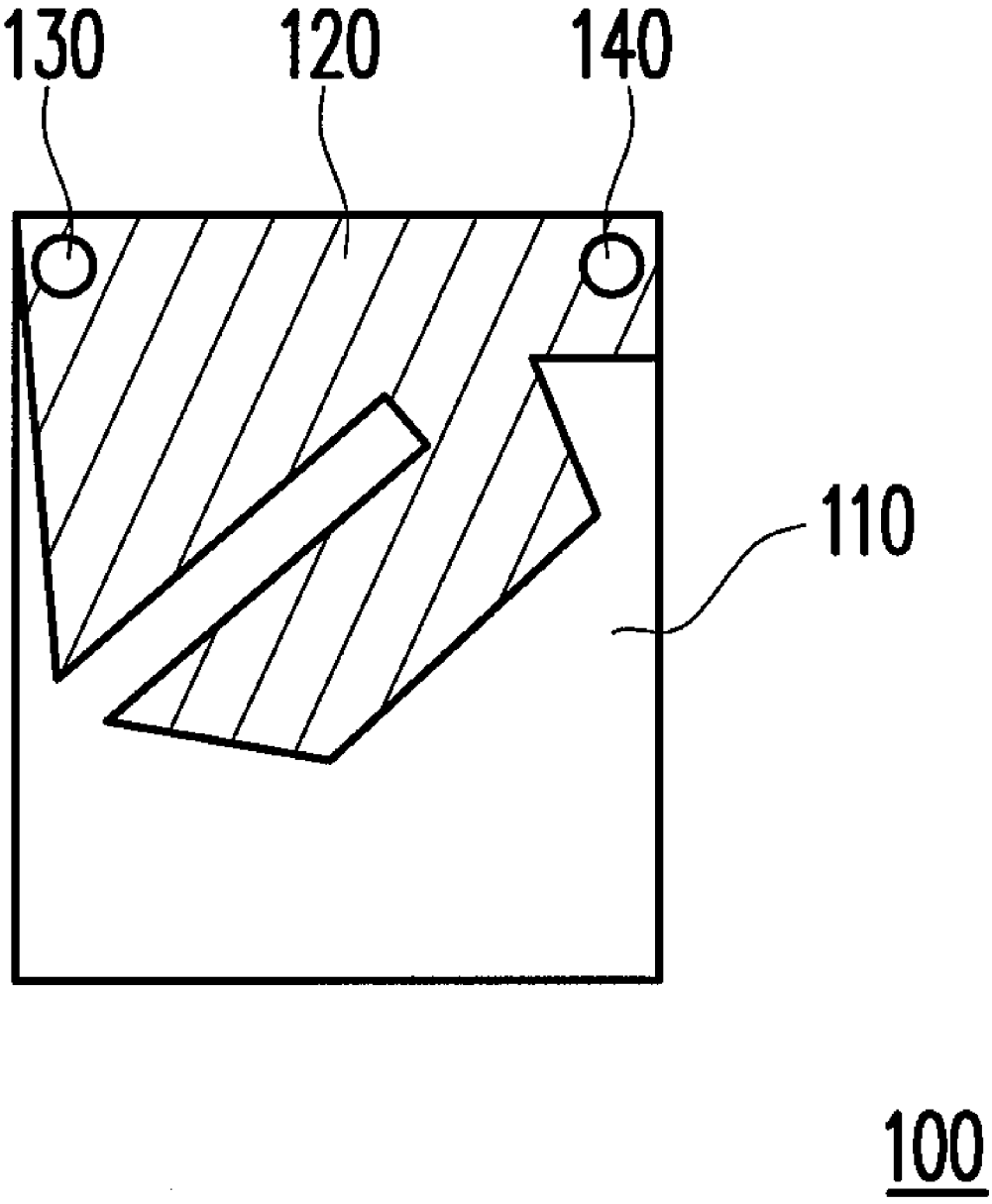
FIG. 5 is a top view of the handheld electronic device as shown in FIG. 1.

FIG. 5 is a top view of the handheld electronic device as shown in FIG. 1. Referring to FIG. 5, the antenna 120 is fixed to the appearance 110 via the first fastening element 130 and the second fastening element 140. The first fastening element 130 and the second fastening element 140 are respectively located at two ends of the antenna 120. In addition, the profile of the antenna 120 can be modified to meet the requirement of structural or artistic design.

To sum up, the antenna of the handheld electronic device of the present invention covers a surface of the appearance and occupies no inner space of the handheld electronic device, and the performance of the antenna can also be improved. The antenna covering the surface of the appearance is far away from the head of a user so as to alleviate the phantom effect or interference to a HAC or other equipments on the head. Furthermore, the profile of the antenna can be modified by various colors or patterns, such as painting the antenna in manufacturing process, so as to improve the variety of the handheld electronic device and attract more visions on the market.

In addition, the handheld electronic device requires fasteners for fixing related essential elements. The present invention applies the fasteners for not only fixing elements but also serving as the feed-in region and the ground region of the antenna without any additional accessory such as a spring finger or an antenna carrier to save the cost and enhance the rigidity of the whole structure.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A handheld electronic device, comprising:

an appearance provided with a containing space for disposing a communication module and a substrate having a ground plane;

an antenna disposed on a surface of the appearance, wherein in the antenna comprises a ground region and a feed-in region, the ground region is electrically connected to the ground plane and the feed-in region electrically connected to the communication module;

a first fastening element and a second fastening element for fixing the appearance and the substrate, the first fastening element and the second fastening element electrically connecting the antenna to the ground plane and the communication module;

a first opening penetrating the appearance, by which the antenna extends into the containing space;

a third fastening hole penetrating a part of the antenna, wherein the part of the antenna is disposed in the first opening; and a fourth fastening hole covered by a second electroplating layer and penetrating the substrate, wherein the first fastening element is fastened in the third fastening hole and the fourth fastening hole such that the antenna extending into the containing space is in contact with the second electroplating layer and electrically connected to the ground plane.

2. The handheld electronic device according to claim 1, wherein the second electroplating layer is connected to the ground plane, and the antenna and the ground region are electrically connected to the ground plane via the second electroplating layer.

3. The handheld electronic device according to claim 2, wherein the ground region is located at a joint location of the antenna and the second electroplating layer.

4. The handheld electronic device according to claim 1, wherein the antenna and the ground region are electrically connected to the ground plane via the first fastening element and the second electroplating layer.

5. The handheld electronic device according to claim 4, wherein the ground region is located at a joint location of the first fastening element and the second electroplating layer.

6. The handheld electronic device according to claim 1, further comprising:

a fifth fastening hole penetrating the appearance and the antenna; and a sixth fastening hole penetrating the substrate, wherein the second fastening element is fastened into the fifth fastening hole and the sixth fastening hole such that the antenna and the feed-in region are electrically connected to the communication module via the second fastening element.

7. The handheld electronic device according to claim 6, further comprising:

a third electroplating layer covering the sixth fastening hole; and a first circuit connected between the third electroplating layer and the communication module, wherein the antenna and the feed-in region are electrically connected to the communication module via the second fastening element, the third electroplating layer and the first circuit.

8. The handheld electronic device according to claim 7, wherein the feed-in region is located at a joint location of the second fastening element and the third electroplating layer.

9. The handheld electronic device according to claim 1, further comprising:

a second opening penetrating the appearance such that the antenna extends into the containing space;

a seventh fastening hole penetrating a part of the antenna, wherein the part of the antenna is disposed in the second opening; and an eighth fastening hole covered by a fourth electroplating layer and penetrating the substrate, wherein the second fastening element is fastened into the seventh fastening hole and the eighth fastening hole such that the antenna extending into the containing space is in contact with the fourth electroplating layer and electrically connected to the communication module.

10. The handheld electronic device according to claim 9, further comprising:

a second circuit connected between the fourth electroplating layer and the communication module, wherein the antenna and the feed-in region are electrically connected to the communication module via the fourth electroplating layer and the second circuit.

11. The handheld electronic device according to claim 10, wherein the feed-in region is located at a joint location of the antenna and the fourth electroplating layer.

12. The handheld electronic device according to claim 10, wherein the antenna and the feed-in region are electrically connected to the communication module via the second fastening element, the fourth electroplating layer and the second circuit.

13. The handheld electronic device according to claim 12, wherein the feed-in region is located at a joint location of the second fastening element and the fourth electroplating layer.

14. The handheld electronic device according to claim 1, wherein the substrate has a first surface and a second surface being opposite to the first surface, and the communication module and the ground plane are respectively disposed on the first surface and the second surface.

15. The handheld electronic device according to claim 1, wherein the substrate is a printed circuit board.

16. The handheld electronic device according to claim 1, wherein the handheld electronic device is a smart cell phone, a multimedia player, a personal digital assistant, or a global positioning system.

* * * * *